US005569892A

United States Patent [19]

Shiga et al.

[11] Patent Number: 5,569,892

[45] Date of Patent: Oct. 29, 1996

[54] MAGNET SWITCH FOR STARTER

[75] Inventors: Tsutomu Shiga, Nukata-gun; Nobuyuki Hayashi, Nagoya; Masanori Ohmi, Anjo, all of Japan

[73] Assignee: Nippondenso Co., Ltd., Kariya, Japan

[21] Appl. No.: 385,549

[22] Filed: Feb. 8, 1995

[30] Foreign Application Priority Data

Oct. 5, 1994 [JP] Japan ..... 6-241143

[51] Int. Cl.[6] ..... H01H 1/38; H01R 4/48

[52] U.S. Cl. ..... 200/19 R; 439/816

[58] Field of Search ..... 200/19 R–33 R, 200/283, 284, 51 R–51.17; 439/506, 625, 626, 652, 694, 697, 730, 734, 749, 809, 854, 855, 860, 878, 881, 882, 888, 439, 816; 318/71; 335/195

[56] References Cited

U.S. PATENT DOCUMENTS

| | | | |
|---|---|---|---|
| 2,170,961 | 8/1939 | Borgkvist | 200/165 |
| 3,242,283 | 3/1966 | Clements | 335/188 |
| 3,571,770 | 3/1971 | Dew | 335/256 |
| 3,604,876 | 9/1971 | Pasbrig | 200/275 |
| 3,638,171 | 1/1972 | Huibrechtse | 439/816 X |
| 4,130,331 | 12/1978 | Neff et al. | 439/396 |
| 4,175,822 | 11/1979 | Debaigt | 439/625 |
| 4,701,000 | 10/1987 | Suprono | 439/423 |
| 4,776,812 | 10/1988 | Boissonnet et al. | 439/407 |
| 5,427,550 | 6/1995 | Jaag | 439/709 |
| 5,428,330 | 7/1995 | Tamemoto | 335/236 |

FOREIGN PATENT DOCUMENTS

| | | | |
|---|---|---|---|
| 3503370 | 8/1986 | Germany | H01R 4/48 |
| 61-27467 | 2/1986 | Japan | H02K 7/10 |

*Primary Examiner*—J. R. Scott
*Attorney, Agent, or Firm*—Cushman, Darby & Cushman

[57] ABSTRACT

A magnet switch which can prevent formation of dew between a movable contact and a fixed contact under the low temperature condition. A cover is made of an insulating material having a base, and the fixed contact is supported in the cover. The fixed contact is connected with the tip portion of an external power feed wire covered with a coating sheath or outer layer of insulation. The tip is embedded in the cover together with the coating sheath or outer layer of insulation, thus eliminating an external power feed terminal with a large surface area that is exposed to the atmosphere. The fixed contact is not cooled even under low temperature condition, and dew condensation between the fixed contact and movable contact can be securely prevented.

11 Claims, 3 Drawing Sheets

MAGNET SWITCH FOR STARTER

CROSS REFERENCE TO RELATED APPLICATION

This application is based upon and claims priority of a Japanese Patent Application No. 6-241143 filed Oct. 5, 1994, the content of which is incorporated herein by reference.

BACKGROUND OF THE INVENTION

1. Field of the Invention

The present invention relates to a magnet switch for a starter used to start internal combustion engines.

2. Related Art

In Japanese Utility Model Publication No. 61-27467, a magnet switch for a starter is disclosed. In such a magnet switch, a terminal bolt is set on the end of a fixed contact of the magnet switch, and a terminal set on the tip portion of an external power feed wire is connected to this terminal bolt and screwed in with a nut. Furthermore, a cap is used to cover the terminal bolt, external power feed wire terminal and nut.

However, in the above magnet switch although a cap is provided which covers the terminal bolt, external power feed wire terminal and nut, if the outdoor temperature is remarkably lowered, the external power feed wire terminal, which hasa large surface area set on the tip of the external power feed wire through which a large current flows, the terminal bolt or the connecting terminal cools the fixed contact causing the formation of dew thereon. The dew will freeze, preventing the movable contact from directly contacting the fixed contact, and thus the starter may not operate.

SUMMARY OF THE INVENTION

It is therefore an object of the present invention to provide a magnet switch for a starter that can prevent the formation of dew between a fixed contact and a movable contact under low temperature conditions.

According to the present invention, a cover has a base made of insulating material, and a fixed contact is set in this cover. This fixed contact is connected with the tip portion of an external power feed wire of which the periphery is covered with a coating. The tip of the external power feed wire is embedded in the cover together with the coating, thus, an external power feed terminal that has a large surface area that is exposed to the atmosphere is not used. Therefore, the fixed contact is not cooled even under low temperature conditions, and dew condensation or formation between the fixed contact and movable contact can be securely prevented. Furthermore, no cap that covers the terminal bolt, nut to fix the external power feed wire and the like is necessary, thus reducing number of the component parts.

Preferably, a through hole is formed from the exterior of the cover toward the fixed contact in the cover, and the tip portion of the external power feed wire is inserted into this hole and connected with the fixed contact. Thus, connection of the external power feed wire to the fixed contact is simplified, and assembly can be facilitated.

More preferably, the fixed contact is formed in a U-shape, and a stay having a loosening prevention portion is placed in the U-shaped space so that the tip portion of the external power feed wire can be held between the loosening prevention portion and fixed contact. This makes the connection of the external power feed wire to the fixed contact even easier, improves assembly, and also securely prevents the external power feed wire from detaching from the fixed contact.

Still more preferably, a pressing member to press a stay loosening prevention portion is set at a position opposing the stay loosening prevention portion of the cover. When the external power feed wire is attached or detached, the stay loosening prevention portion is press-fit with the pressing member to release the connection of the external power feed wire and fixed contact. This makes attaching and detaching the external power feed wire from the fixed contact easier.

Still more preferably, a fixing member that acts as the fixed contact is fixed on the tip portion of the external power feed wire, and the external power feed wire and fixing member are molded and formed integrally with the cover. Thus, the clearance between the external power feed wire and cover is eliminated, thereby preventing water from entering and securely preventing dew from condensing between the fixed contact and movable contact.

DETAILED DESCRIPTION OF THE PREFERRED EMBODIMENTS

Figure 2:
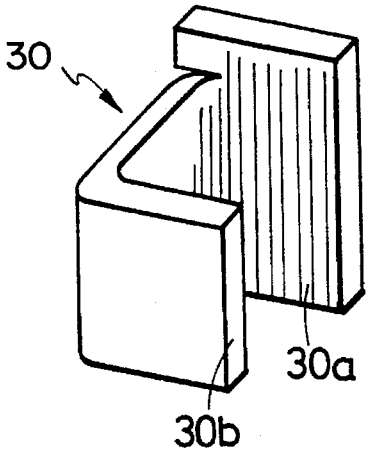
FIG. 2 is a perspective view illustrating a fixed contact used in the embodiment of FIG. 1.
Figure 3:
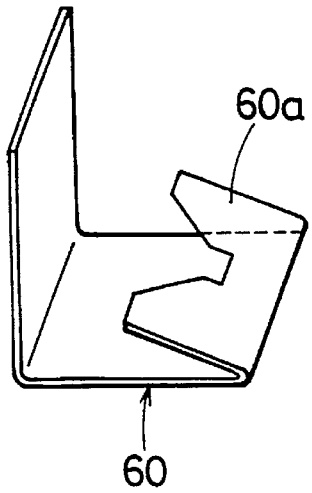
FIG. 3 is a perspective view illustrating a stay used in the embodiment of FIG. 1.

The first embodiment of a magnet switch for starter according to the present invention will be described with reference to FIGS. 1 through 3.

Figure 1:
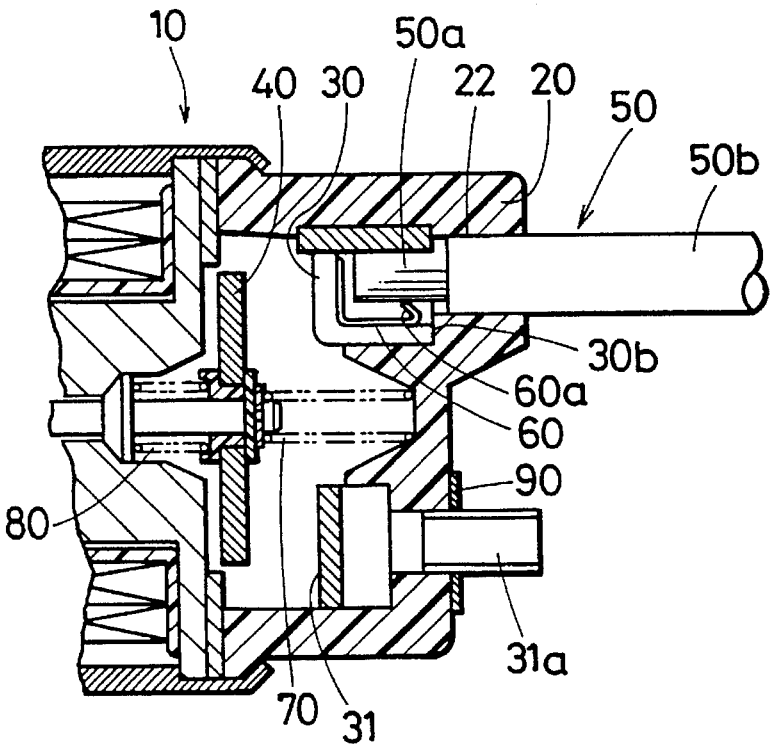
FIG. 1 is a partial cross-sectional view illustrating a first embodiment of a magnet switch for starter according to the present invention.

In FIG. 1, reference numeral 10 denotes a magnet switch for a starter, and numeral 20 denotes a cover having a base made of, for instance, heat-hardening phenolic resin. A pair of fixed contacts 30 and 31 positioned relative to a disk-like movable contact 40 (described later) are placed or set inside the cover 20. As shown in FIG. 2, the fixed contact 30 is formed in a generally U-shape. Multiple grooves **30*a* are formed on one inside wall of the U-shape. A copper wire portion 50*a* of an external power feed wire 50 described later contacts these grooves 30*a*. The fixed contact 30 is fixed in such a way that the tip 30*b* of the fixed contact 30 directly contacts the inner wall of the cover 20. A stay 60 has a loosening prevention portion 60*a* of which the end is formed in a V-shape as shown in FIG. 3 and is placed inside the space of the fixed contact 30. The stay 60 is made of an elastic conductive plate (e.g., copper plate) and is set so that the loosening prevention portion 60*a* is positioned to face the grooves 30*a* of the fixed contact 30**.

The external power feed wire 50 is covered with a sheath or coating **50*b*, and the tip portion is formed with the copper wire portion 50*a* that is connected to the fixed contact 30 at the grooves 30*a*. The electric power is fed from a vehicle storage battery (not illustrated) to the fixed contact 30. The external power feed wire 50 is inserted into the cover 20 through a through hole 22 formed from the outside to the inside. The copper wire portion 50***a* is fixed between the loosening prevention portion 60*a* and fixed contact 30.

A fixed contact 31 formed as a pair with the fixed contact 30 is fixed to a terminal bolt 31*a* of to which the lead wire (not illustrated) that feeds the electric power to a starter motor (not illustrated) is connected. This terminal bolt 31*a* is also fixed to the cover 20 by a washer 90.

A first spring 70 biases the movable contact 40 away from the fixed contact 30, and a second spring 80 biases the movable contact 40 toward the fixed contact 30. When the movable contact 40 directly contacts the fixed contact 30, the electric power is fed from the battery (not illustrated) to the starter motor (not illustrated) in a well known manner.

With this structure, the tip portion of the external power feed wire 50 is embedded in the cover 20 together with the coating 50*b*, so there is no external power feed wire terminal with a large surface area that is exposed to the atmosphere. Therefore, the fixed contact 30 is not cooled, and dew condensation or formation between the fixed contact 30 and movable contact 40 can be securely prevented. Furthermore, the terminal bolt, nut to fix the external power feed wire and a cap to cover the contact bolt, external power feed wire terminal and nut are not required, so the number of component parts can be reduced.

The through hole 22 is formed from the exterior of the cover 20 toward the fixed contact 30 within the cover 20, and the tip portion of the external power feed wire 50 is inserted in the hole 22 and connected with the fixed contact 30. Thus, connection of the external power feed wire 50 to the fixed contact 30 can be simplified, and assembly can be facilitated.

The fixed contact 30 is formed into the U-shape, and the stay 60 having the loosening prevention portion 60*a* is set in the U-shaped space so that the tip portion of the external power feed wire 50 can be held between the loosening prevention portion 60*a* and fixed contact 30. This makes the connection of the external power feed wire 50 to the fixed contact 30 even easier, improves the assembly work, and also securely prevents the external power feed wire 50 from detaching from the fixed contact 30. The grooves 30*a* further assures electrical and mechanical connection of the wire 50 to the fixed contact 30.

Other embodiments will be described with reference to FIGS. 4 through 6.

Figure 4:
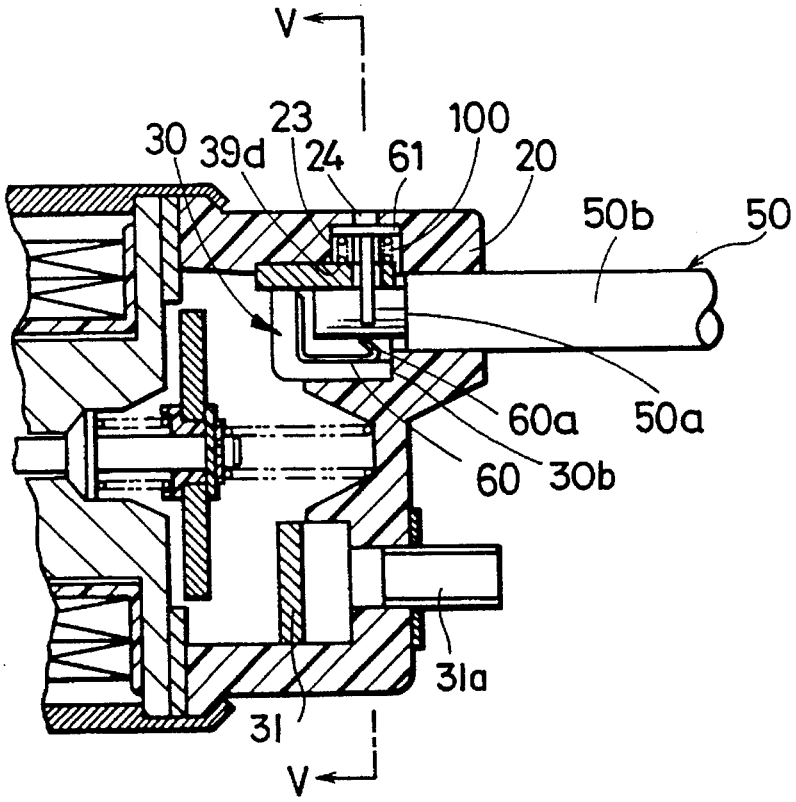
FIG. 4 is a partial cross-sectional view illustrating a second embodiment of a magnet switch for starter according to the present invention.
Figure 5:
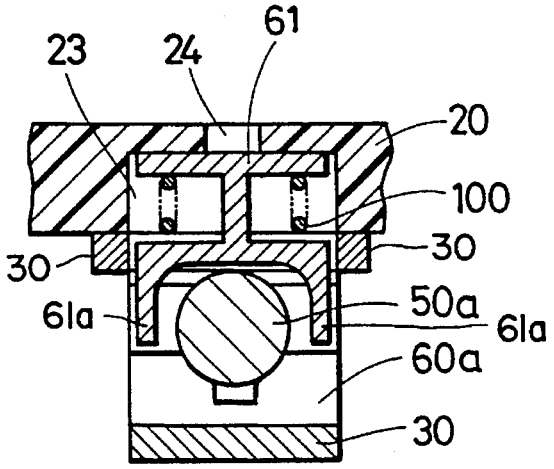
FIG. 5 is a partially enlarged cross-sectional view of a part taken along the V—V line in FIG. 4.

FIG. 4 is a partial cross-sectional view of the magnet switch for starter according to the second embodiment and FIG. 5 is a partial, enlarged cross-sectional view illustrating the a cross-section taken along the line V—V in FIG. 4.

In the second embodiment illustrated in FIGS. 4 and 5, a pressing member 61 is disposed to press the loosening prevention portion 60*a* of the stay 60, and a spring 100 is disposed to bias the pressing member 61 in the direction away from the loosening prevention member 60*a*, i.e., upwardly in FIGS. 4 and 5. The spring and upper portion of pressing member 61 are set in a first groove 23 formed in the radial direction of the cover 20, which is generally cylindrical. The spring 100 is set between the pressing member 61 and the upper end 39*d* of the fixed contact 30. To assemble the external power feed wire 50, the copper wire portion 50*a* of the external power feed wire 50 is passed through the through hole 22 in the cover 20 toward the loosening prevention portion 60*a* of the stay 60 while slackening the loosening prevention portion 60*a*. The copper wire portion 50*a* is fixed between the fixed contact 30 and the loosening prevention portion 60*a* of the stay 60. To detach the external power feed wire 50, i.e. a battery cable, the pressing member 61 is pressed down toward the loosening prevention portion 60*a* against the spring 100 through a second groove 24 having a smaller diameter than the first groove 23. Thus, the loosening prevention portion 60*a* is directly contacted by portion 61*a* of pressing member 61 and deformed. This releases the direct contact of the copper wire portion 50*a* of the external power feed wire 50 and the loosening prevention portion 60*a*, and the external power feed wire 50 separates from the fixed contact 30. With this structure, the external power feed wire 50 can be freely attached or detached with ease without detaching the cover.

Figure 6:
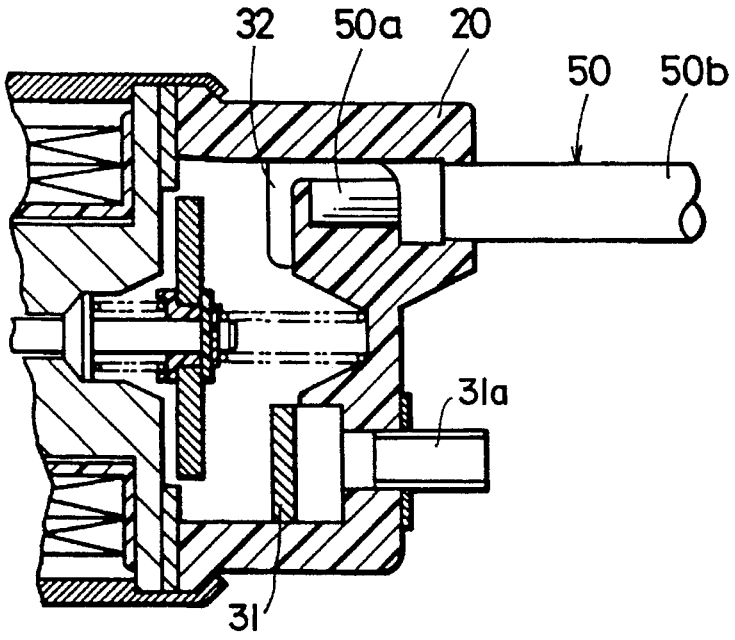
FIG. 6 is a partial cross-sectional view illustrating a third embodiment of a magnet switch for starter according to the present invention.

Next, in the third embodiment illustrated in FIG. 6, an L-shaped fixing member 32 is attached to the copper wire portion 50*a* of the external power feed wire 50, and the external power feed wire 50 and fixing member 32 are molded and formed integrally with the cover 20. In this case, one end (the leftmost part in FIG. 6) of the fixing member 32 is used as the fixed contact. The fixing member 32 is formed of a copper plate or a copper-plated metal, for example.

In each of the above embodiments, the terminal bolt 31*a* is used for the fixed contact 31, however, the lead wire and fixed contact 31 can be connected to the starter motor to achieve the same structure as the fixed contact 30.

The present invention has been described with reference to the presently preferred embodiments illustrated in the accompanying drawings. It is to be understood, however, that the present invention should not be restricted to the above-described embodiments but may be modified in many ways without departing from the spirit of the invention.

What is claimed is:

1. A magnet switch for a starter comprising:

a fixed contact;

a movable contact movable to contact said fixed contact;

a cover made of an insulating material and having a bottom for supporting said fixed contact; and an external power feed wire for supplying electric power from a battery to the fixed contact, said electric power feed wire having a tip portion connected with said fixed contact and being covered with an insulating type coating except for said tip portion, said movable contact supplying electric power from the battery to a starter;

wherein said tip portion of said external power feed wire is encased within said cover with said coating.

2. The magnet switch for starter comprising:

a fixed contact;

a movable contact movable to contact said fixed contact;

a cover made of an insulating material and having a bottom for supporting said fixed contact; and an external power feed wire having a tip portion connected with said fixed contact and covered with an insulating type coating except for said tip portion;

wherein said tip portion of said external power feed wire is encased within said cover with said coating, wherein said cover is formed with a through hole on said bottom at a position facing said fixed contact, and wherein said external power feed wire passes through said hole with said coating contacting said cover.

3. The magnet switch for starter according to claim 2, wherein said fixed contact is formed in generally U-shape, wherein a stay is disposed in a space of said U-shaped fixed contact adjacent one part of said fixed contact and facing an other part of said fixed contact and having a loosening prevention portion extending toward said other part of said fixed contact, and wherein said tip portion of said external power feed wire is held between said loosening prevention portion and said other part of said fixed contact.

4. The magnet switch for starter according to claim 3 further comprising:

a pressing member placed movably in said cover at a position opposing said loosening prevention portion for deforming said loosening prevention portion when pressed from outside of said cover, so that connection of said tip portion of said external power feed wire with said fixed contact is released.

5. The magnet switch for starter comprising:

a fixed contact;

a movable contact movable to contact said fixed contact;

a cover made of an insulating material and having a bottom for supporting said fixed contact; and an external power feed wire having a tip portion connected with said fixed contact and covered with an insulating type coating except for said tip portion;

wherein said tip portion of said external power feed wire is encased within said cover with said coating, wherein said external power feed wire and said fixed contact are molded and formed integrally with said cover with a part of said fixed contact being exposed from said cover for connection.

6. A magnet switch comprising:

an electric power lead wire covered with an insulating type coating;

a fixed contact connected with said lead wire, said lead wire supplying electric power from a battery to the fixed contact;

a movable contact movable to contact with said fixed contact, said movable contact supplying electric power from the battery to a starter;

a cap made of an electrically insulated material and formed in a generally cup shape to encase said movable contact and said fixed contact therein, said cap having a hole on a bottom of said cup shape for passing said lead wire therethrough with said coating of said lead wire contacting therewith in said hole.

7. A magnet switch comprising:

an electric power lead wire covered with an insulating type coating;

a fixed contact connected with said lead wire;

a movable contact movable to contact with said fixed contact;

a cap made of an electrically insulated material and formed in a generally cup shape to encase said movable contact and said fixed contact therein, said cap having a hole on a bottom of said cup shape for passing said lead wire therethrough with said coating of said lead wire contacting therewith in said hole;

a stay interposed between said lead wire and said fixed contact and having a loosening prevention portion formed to keep said lead wire fixed to said fixed contact;

a pressing member placed in said cap at a position opposing said loosening prevention portion of said stay for selectively deforming said loosening prevention portion to release connection of said lead wire and said fixed contact, when pressed; and external means formed on said cap for enabling pressing of said pressing member from outside said cap so that said connection of said lead wire and said fixed contact can be released without removal of said cap.

8. A magnet switch according to claim 7, further comprising:

a spring disposed in said cap and normally biasing said pressing member in a direction away from said loosening prevention portion.

9. A magnet switch according to claim 8, wherein said external means includes a hole formed on said cap through which said pressing member can be selectively pressed from an exterior of said cap.

10. A magnet switch for a starter comprising:

a fixed contact;

a movable contact movable to contact said fixed contact;

a cover made of an insulating material and having a bottom for supporting said fixed contact; and an external power feed wire having a tip portion connected with said fixed contact and being covered with an insulating type coating except for said tip portion;

wherein said tip portion of said external power feed wire is encased within said cover with said coating;

wherein said fixed contact, said moveable contact, and said tip portion of said external power feed wire are entirely protected from an outside atmosphere by said cover and said insulating type coating.

11. A magnet switch comprising:

an electric power lead wire covered with an insulating type coating;

a fixed contact connected with said lead wire;

a movable contact movable to contact with said fixed contact;

a cap made of an electrically insulated material and formed in a generally cup shape to encase said movable contact and said fixed contact therein, said cap having a hole on a bottom of said cup shape for passing said lead wire therethrough with said coating of said lead wire contacting therewith in said hole;

wherein said fixed contact, said moveable contact, and a tip portion of said lead wire are entirely protected from an outside atmosphere by said cap and said insulating type coating.

* * * * *